United States Patent [19]

Martin et al.

[11] 4,239,029

[45] Dec. 16, 1980

[54] GRATE FOR INDUSTRIAL FURNACES

[75] Inventors: Johannes J. Martin; Walter J. Martin; Erich Weber, all of Munich, Fed. Rep. of Germany

[73] Assignee: Josef Martin Feuerungsbau GmbH, Munich, Fed. Rep. of Germany

[21] Appl. No.: 14,769

[22] Filed: Feb. 23, 1979

[30] Foreign Application Priority Data

Feb. 24, 1978 [DE] Fed. Rep. of Germany ..... 2808057

[51] Int. Cl.[3] ..... F23H 1/02

[52] U.S. Cl. ..... 126/163 R; 110/268; 110/281; 126/152 R

[58] Field of Search ..... 126/163 R, 152 R, 152 B; 110/268, 281, 282, 257, 289–291

[56] References Cited

U.S. PATENT DOCUMENTS

| | | | |
|---|---|---|---|
| 3,014,439 | 12/1961 | Mitchell et al. | 110/268 |
| 3,508,535 | 4/1970 | Martin et al. | 126/163 R |
| 3,985,084 | 10/1976 | Delaplace | 110/281 |
| 4,170,183 | 10/1979 | Cross | 110/268 |

*Primary Examiner*—George T. Hall

*Attorney, Agent, or Firm*—Peter K. Krontler

[57] ABSTRACT

A grate for industrial furnaces wherein each row of grate bars includes alternating stationary and reciprocable bars. The stationary bars which flank a reciprocable bar are connected to each other by a bolt which extends transversely of the stationary bars and of the reciprocable bar therebetween and has hook-shaped end portions or screws engaging the inner sides of ribs forming part of the stationary bars and adjacent to the respective side of the reciprocable bar. The median portion of the bolt extends through elongated slots in the ribs which are provided at the underside of the reciprocable bar. The latter moves with respect to the bolt and with respect to the adjacent stationary bars.

28 Claims, 17 Drawing Figures

FIG. 1
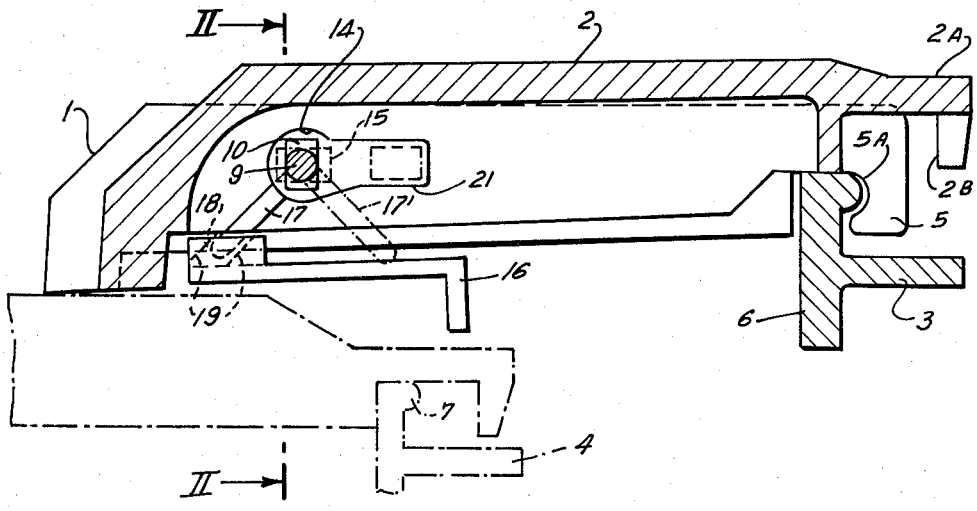
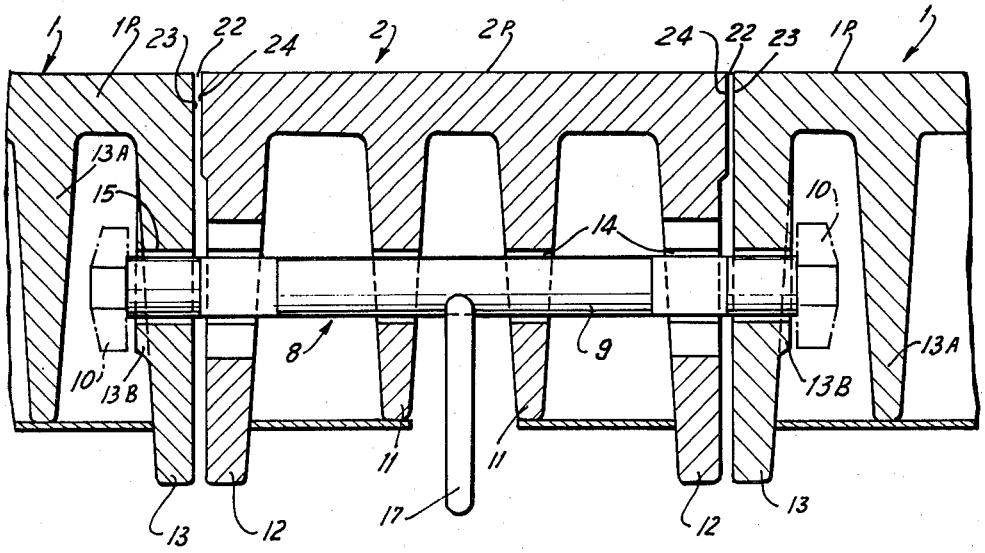
FIG. 2

FIG. 7
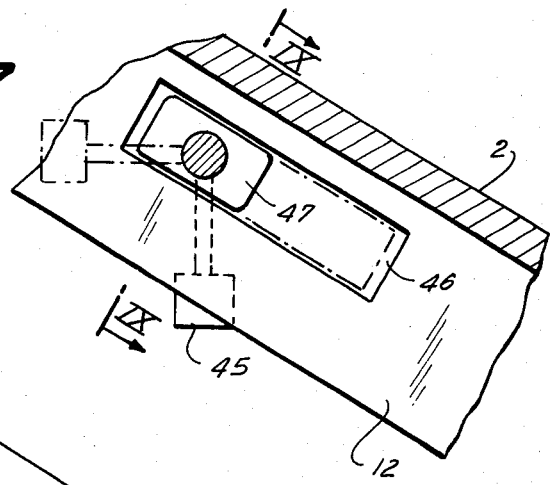
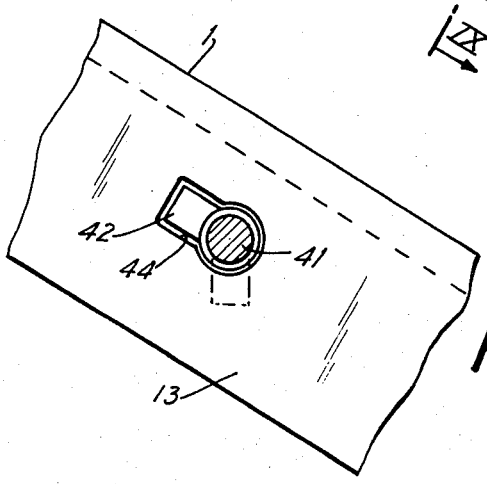
FIG. 8
FIG. 9
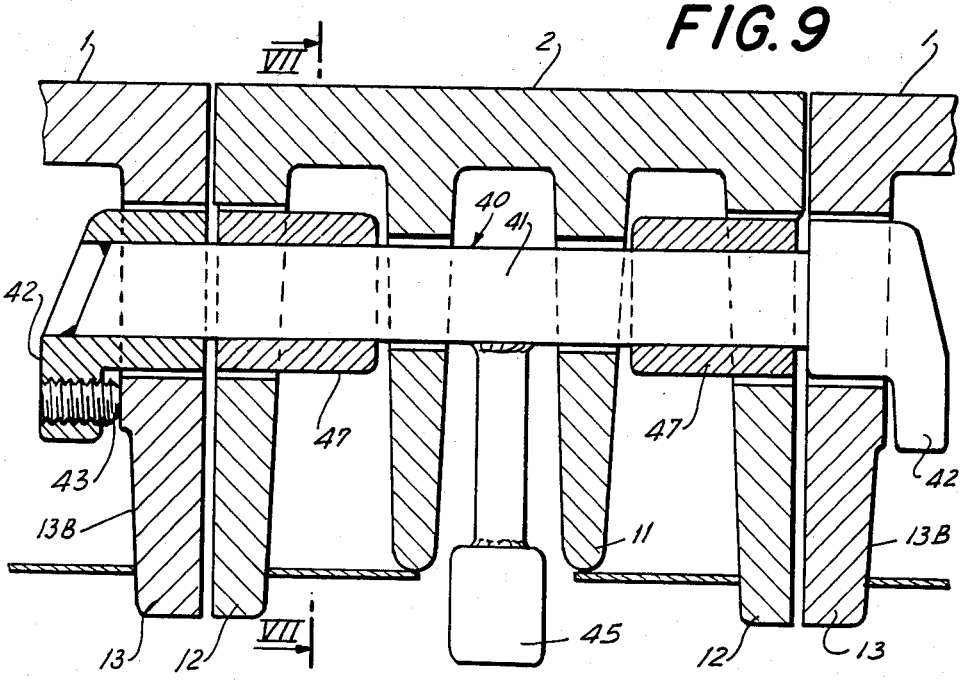

GRATE FOR INDUSTRIAL FURNACES

BACKGROUND OF THE INVENTION

The present invention relates to improvements in grates for industrial furnaces or the like, and more particularly to improvements in grates wherein mobile grate bars alternate with stationary grate bars. Still more particularly, the invention relates to improvements in grates of the type wherein mobile grate bars are coupled with but can be displaced relative to the adjacent stationary grate bars.

German Pat. No. 911,317 discloses a grate wherein each step comprises mobile and stationary grate bars. The mobile grate bars have laterally extending hook-shaped projections which extend through openings provided in the adjacent flanges or ribs of stationary grate bars. The projections overlie the inner sides of the respective ribs to establish connections between the mobile and stationary bars. The openings in the ribs are elongated slots which enable the mobile grate bars to perform requisite movements with respect to the adjacent stationary bars.

A drawback of grates which are disclosed in the aforementioned German patent is that the clearances between stationary and mobile grate bars cannot be selected and maintained with a requisite degree of precision. This is due to the fact that the stationary grate bars are normally produced by casting or forging and the inner sides of their ribs are not machined or otherwise treated so that the distance (i.e., the width of clearances) between neighboring stationary and mobile grate bars varies in response to sliding movement of projections along the normally uneven inner sides of adjacent ribs forming part of the stationary grate bars. Another reason for continuous or intermittent variations of the width of clearances between stationary and mobile grate bars is that the mobile grate bars including the aforementioned hook-shaped projections, too, are not machined with a high degree of precision. During movement of mobile grate bars with respect to neighboring stationary grate bars, rough (i.e., untreated) surfaces of mobile bars slide along similarly untreated surfaces of stationary grate bars which results in pronounced friction and extensive wear upon stationary and mobile bars. The wear is especially pronounced upon the projections whose dimensions are relatively small (the width of such projections is normally in the range of 20 millimeters) so that the projections wear away and the width of clearances between the mobile and stationary grate bars increases accordingly. As the width of clearances increases, the dimensions of solid particles which penetrate or can penetrate between the mobile and stationary grate bars also increase; this can affect the length of strokes which are performed by mobile grate bars and can also result in jamming of the grate. If several mobile grate bars are held against movement at one and the same time, the mechanism which reciprocates or otherwise moves the mobile bars is likely to be damaged or destroyed or to be incapable of effecting any movements of the grate and/or grate bars. The situation is aggravated if the width of clearances increases at both sides of a given mobile grate bar; the frictional force which is generated by relatively large solid particles of foreign matter between the stationary grate bars and the mobile bar then increases to such an extent that the mobile bar invariably comes to a full stop. Jamming can be caused by particles of rock, stone, clinker and/or metallic parts which are contained in the fuel, e.g., in refuse if the grate is used in an incinerator plant.

OBJECTS AND SUMMARY OF THE INVENTION

An object of the invention is to provide a grate wherein the width of clearances between stationary and mobile grate bars can be maintained at a constant or nearly constant value in a simple and inexpensive way.

Another object of the invention is to provide novel and improved connecting means between stationary and mobile grate bars which constitute component parts of a grate in an incinerator plant or the like.

An additional object of the invention is to provide a grate wherein the friction between stationary and mobile grate bars is less pronounced than in heretofore known grates.

A further object of the invention is to provide a grate wherein the width of clearances between neighboring stationary and mobile grate bars can be adjusted and selected during initial assembly of the grate and/or during periods of idleness of the furnace wherein the grate is put to use.

Another object of the invention is to provide a grate wherein the width of clearances between neighboring stationary and mobile grate bars can be selected with any desired degree of precision by resorting to simple, compact and rugged component parts.

A further object of the invention is to provide novel and improved stationary and mobile grate bars for use in a grate of the above outlined character.

Another object of the invention is to provide novel and improved connecting units which couple stationary and mobile grate bars to each other.

An additional object of the invention is to provide novel and improved auxiliary connecting units which movably couple marginal stationary grate bars to the frame of a grate.

The invention is embodied in a grate for an industrial furnace or the like (e.g., for use in an incinerator plant) which comprises a stationary or mobile support or frame, a pair of spaced apart parallel first elongated grate bars which are mounted in the support, a second elongated grate bar disposed between and movable relative to the first bars, and means for connecting the first bars to each other including an elongated coupling member having first and second ends (the coupling member may constitute a flat, round or otherwise configurated bolt) and a preferably hook-shaped, externally threaded or otherwise configurated retaining element disposed at each end of the coupling member and extending transversely of the coupling member (the latter extends transversely of the first and second grate bars). The first bars include flanges, ribs or analogous portions which are adjacent to the second grate bar and have first openings through which the coupling member extends and inner sides adjacent to the respective retaining elements so that the maximum distance between such portions of the first bars is determined by the minimum distance between the two retaining elements. The second bar includes at least one section (e.g., one or more downwardly extending ribs or flanges) disposed between the portions of the first bars and having a second opening through which the coupling member extends and which is sufficiently large to allow the second bar to move with respect to the first bars and with respect to the connecting means.

The second opening may constitute or comprise an elongated slot which permits lengthwise reciprocatory movements of the second bar with respect to the first bars.

The distance between the first grate bars exceeds the width of the second bar, as considered in the longitudinal direction of the coupling member. This results in development of a clearance between the second grate bar and at least one first grate bar, and the width of this clearance preferably need not appreciably exceed (and is normally less than) one millimeter. Such narrow clearances are less likely to permit particles of stone, rock, clinker, metal or the like to penetrate between the second grate bar and the one and/or other first grate bar.

The novel features which are considered as characteristic of the invention are set forth in particular in the appended claims. The improved grate itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 1 is a longitudinal sectional view of a mobile grate bar and an elevational view of a stationary grate bar in a step wherein the stationary and mobile grate bars are coupled to each other by a connecting unit embodying one form of the invention, a modified construction of the frame or support for the grate bars being indicated by phantom lines;

FIG. 2 is an enlarged sectional view as seen in the direction of arrows from the line II—II of FIG. 1;

FIG. 7 is a fragmentary longitudinal sectional view of the mobile grate bar in a grate which embodies a third connecting unit;

FIG. 8 is a fragmentary elevational view of a stationary grate bar which forms part of a grate embodying the third connecting unit;

FIG. 9 is an enlarged sectional view as seen in the direction of arrows from the line IX—IX of FIG. 7;

DESCRIPTION OF THE PREFERRED EMBODIMENTS

Figure 3:
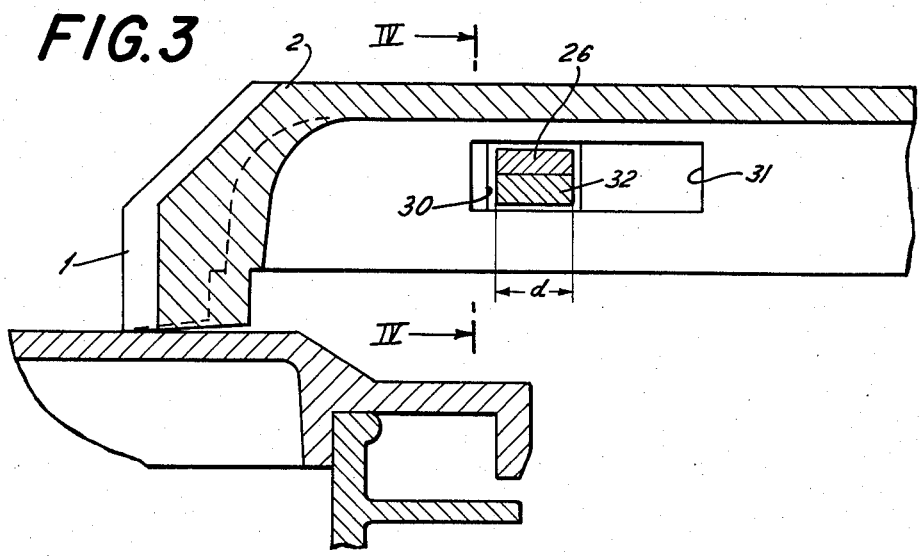
FIG. 3 is a sectional view similar to that of FIG. 1 but showing a second connecting unit.

Referring first to FIGS. 1 and 2, there is shown a portion of one step of a downwardly inclined grate, namely, two stationary elongated parallel first grate bars 1 which flank a mobile elongated second grate bar 2. The mobile grate bars 2 of each step of the grate are movable up and down, i.e., counter and in the direction of movement of fuel along the step toward the depository for slag. For example, each step of the grate may comprise six stationary bars 1 and five mobile bars 2, each bar 2 being flanked by two bars 1. The entire step of the grate can move counter to the direction of downward movement of fuel.

FIG. 1 shows, by solid lines, a mobile frame or support 3 for the grate bars 1 and 2. A stationary or fixed frame or support is shown by phantom lines, as at 4. It will be understood that each step of a grate comprises a fixed frame 4 or a mobile frame 3.

The frame 3 has an upstanding rail 6 which extends into the sockets 5A of the free end portions 5 of stationary bars 1 in such a way that the bars 1 cannot move lengthwise. The end portions 2A of the mobile grate bars 2 have sockets 2B which receive the adjacent portions of the rail 6 with a certain amount of play so that the bars 2 can move lengthwise back and forth with respect to the bars 1. The same holds true when the frame (4) is stationary, i.e., the bars 1 cannot move with respect to the rail (7) but the bars 2 are free to move lengthwise to the extent which is determined by the width of their sockets 2B (as considered in the longitudinal direction of the bars 2 and at right angles to the longitudinal direction of the rail 7).

In accordance with a feature of the invention, the bars 1 of each pair of stationary bars which flank a mobile bar 2 are coupled to each other by a connecting unit or clamp 8 which permits the mobile bar 2 to move back and forth, i.e., to reciprocate in and counter to the direction of downward movement of fuel along the upper side of the respective step of the grate. The connecting unit 8 further maintains the respective stationary grate bars 1 at a fixed minimum and/or maximum distance from each other (as considered in the longitudinal direction of the rail 6 or 7) so that the bar 2 therebetween is free to perform the aforementioned reciprocatory movements. This connecting unit is stationary with respect to the corresponding mobile bar 2, i.e., the latter can move relative to the unit 8 at right angles to the axis of such unit. The connecting unit 8 of FIGS. 1 and 2 is designed in such a way that it prevents the two stationary bars 1 from moving apart, i.e., it need not necessarily hold the bars 1 against movement toward each other.

The connecting unit 8 which is shown in FIGS. 1 and 2 comprises an elongated coupling member 9 (hereinafter called bolt for short) with integral hook-shaped end portions or retaining elements 10. The bolt 9 traverses the two outer sections or ribs 12 and the two inner sections or ribs 11 of the mobile bar 2 (see FIG. 2) and also extends through the adjacent outer portions (flanges or ribs) 13 of the corresponding bars 1. The inner ribs of the bars 1 are shown at 13A. The sections or ribs 11, 12 and the portions or ribs 13, 13A respectively extend downwardly from platforms 2P and 1P of the corresponding bars 2 and 1. The end portions or retaining elements 10 extend transversely of the bolt 9 so that they abut against the inner sides 13B of the respective outer ribs 13. This insures that the bars 1 cannot move apart beyond the positions in which their ribs 13 abut against the corresponding end portions 10. The bolt 9 extends through openings 14 in the ribs 11, 12 of the bar 2 and through openings 15 in the adjacent ribs 13 of the bars 1. The configuration of openings 15 conforms to the outlines of the respective end portions 10 so that such end portions can be introduced through and inwardly beyond the respective ribs 13. The bolt 9 is thereupon caused to change its angular position so as to prevent extraction of the end portions 10 through the respective openings 15. This insures that the distance between the ribs 13 of FIG. 2 does not appreciably exceed the illustrated distance when the step of FIGS. 1 and 2 is in actual use or is ready for use. The means for changing the angular position of the bolt 9 comprises a tool 16 in the form of a key or wrench which has a pocket or recess 18 at one of its ends. The pocket 18 is flanked by two projections 19 constituting abutments for the end portion of a lever or arm 17 which is integral with or is rigidly connected with the bolt 9 (see FIG. 2 where the lever 17 is shown between the inner ribs 11 of the mobile grate bar 2). When the lever 17 is pivoted to the solid-line position of FIG. 1, the end portions 10 extend at right angles to the longitudinal directions of the respective openings 15 and the bars 1 are properly coupled to each other. When the tool 16 is actuated to move the lever 17 to the position 17', the end portions 10 register with the respective openings 15 and can be inserted through or withdrawn from the corresponding ribs 13. One of the projections 19 engages and moves the lever 17 when the latter is pivoted in one direction, and the other projection 19 engages and moves the lever when the latter is pivoted in the opposite direction.

The openings 14 in the ribs or sections 11 and 12 of the bar 2 are elongated slots including round portions and elongated slits 20 each of which constitutes an extension of the respective round portion. These openings or slots enable the bar 2 to move relative to the bars 1 and relative to the unit 8 at right angles to the longitudinal direction of the rail 6 or 7, i.e., lengthwise of the two parallel bars 1. FIG. 1 shows the bolt 9 once in the circular portion of one of the openings 14 and once in the respective extension or slit 20. The slit 20 receives the bolt 9 with a certain amount of clearance which is shown at 21.

FIG. 2 further shows clearances 22 which are defined by the outer side faces 23, 24 of neighboring outer ribs 13 and 12. These clearances are sufficient to allow for unimpeded reciprocation of the bar 2 with respect to the bars 1.

An important advantage of the improved grate is that, in contrast to heretofore known grates wherein one or more mobile grate bars alternate with and are flanked by stationary grate bars, the end portions or retaining elements 10 of the connecting unit 8 need not slide relative to the inner sides 13B of the respective outer ribs 13. Thus, the wear upon the end portions 10 and upon the inner sides 13B of the ribs 13 is negligible or nil. Instead, the mobile grate bar 2 can reciprocate with respect to the bolt 9 of the connecting unit 8. Since the openings 14 and their extensions or slits 20 in the sections or ribs 11 and 12 of the mobile grate bar 2 can be readily dimensioned in such a way that the bolt 9 is received therein with a certain amount of play, the wear upon the bolt 9 and/or upon the ribs 11, 12 is also negligible or zero. This contributes to longer useful life of the step which includes the structure of FIGS. 1 and 2. The bars 1 and the connecting unit 8 constitute a stationary assembly wherein the maximum distance between the two outer side faces 23 is fixed by the end portions 10 so that the width of clearances 22 cannot increase as long as the grate bar 2 is not caused to wobble and to frictionally engage the one or the other stationary grate bar 1. Pronounced wear upon the side faces 23 and/or 24 is highly unlikely as long as the means (not shown) for reciprocating the bar 2 guides this bar with a certain degree of precision. Furthermore, and as already mentioned above, the openings 14 in the ribs 11, 12 are sufficiently large to prevent the generation of pronounced frictional forces between the bolt 9 and the mobile grate bar 2.

The term "stationary grate bars" is intended to denote those grate bars which are stationary with respect to the bars 2, i.e., those bars with respect to which the bars 2 are moved when the grate embodying such bars is in actual use. However, the bars 1, too, can constitute movable bars if the entire step which includes the bars 1 and 2 is designed to move in a furnace or the like. Thus, the bars 1 are truly stationary if the frame or support for such bars is stationary, and the bars 1 move with the bars 2 (while the bars 2 simultaneously move relative to the bars 1) when the furnace comprises means (not specifically shown) for moving the frame or support which carries the bars 1.

It has been found that, even if the component parts of the bars 1 and/or connecting unit 8 are not machined or otherwise finished with a high degree of precision, the width of clearances 22 between the bars 1 and 2 can be held to less than one millimeter. This invariably insures that the clearances 22 cannot receive relatively large particles of foreign matter which would be likely to interfere with the length of strokes and/or with any movements of mobile bars 2 with respect to the stationary bars 1. If a clearance 22 receives a single particle of foreign matter or a relatively small number of such particles, the particle or particles are highly unlikely to interfere with predictable reciprocatory and/or other desired movements of the bar 2 with respect to the neighboring bars 1. If such particles actually affect the position, orientation and/or movements of the bar 2, they are most likely to shift the bar 2 sideways so that the outer side face of one of the ribs 12 slides along the outer side face of the neighboring rib 13 until the particles at the other side of the bar 2 descend and permit the bar 2 to reassume its normal position in which the width of clearance at the outer side of one outer rib 12 is the same as the width of clearance at the outer side of the other rib 12. It is often advisable to subject the outer side faces 23 and 24 to at least some secondary treatment, such as polishing and/or grinding. This further reduces the likelihood of jamming when a surface 24 is caused to slide along the adjacent surface 23. Thus, by the simple expedient of grinding and/or polishing the surfaces 23 and/or 24, frictional forces between the grate bars 1 and 2 can be reduced to such an extent that even a large number of particles of foreign matter in one of the gaps 22 is unlikely to effect undesirable stoppage of bars 2 or to reduce the length of strokes the bar 2 performs with respect to the neighboring bars 1. Since the particles which can penetrate into the clearances 22 are invariably small (as mentioned above, the width of such clearances is normally less than one millimeter), these small particles cannot offer great resistance to reciprocatory movements of the bar 2 and are even less likely to effect a complete stoppage of the bar 2. The relatively small particles of foreign matter are unlikely to cause pronounced scratching of the side faces 23 and/or 24. These side faces are preferably large which further reduces the magnitude of frictional forces acting upon unit areas of such side faces in the event of penetration of foreign matter into the one and/or the other clearance 22. The provision of relatively large side faces 23 and 24 further reduces the likelihood of pronounced wear upon such surfaces if they happen to move into frictional engagement with each other. As mentioned above, conventional grates include mobile grate bars with relatively small hook-shaped projections (having a width of not more than 20 mm) which slide along unfinished inner sides of ribs on the stationary bars so that the wear upon such small projections is very pronounced and the width of clearances between the stationary and mobile grate bars increases after a relatively short period of use.

Another important advantage of the improved grate is that the resistance against reciprocation of the bar 2 does not increase if particles of foreign matter penetrate into both clearances 22. The frictional forces which develop under such circumstances are divided between the surfaces flanking the two clearances. In conventional grates wherein the mobile bar has integral hook-shaped projections which slide along the inner sides of ribs forming part of the adjacent stationary bars, the magnitude of frictional forces is doubled if both clearances receive and retain particles of foreign matter while the mobile bar reciprocates with respect to the stationary bars. In other words, friction which is generated between one hook-shaped projection on a conventional mobile grate bar and the adjacent unfinished inner side of one stationary bar is independent of frictional engagement between the other hook-shaped projection and the adjacent unfinished surface of the other stationary bar. As mentioned above, this entails rapid and very pronounced wear upon the hook-shaped projections of a conventional mobile grate bar with the result that the mobile bar jams or the width of clearances at both sides of such bar increases after a short period of use.

Since the end portions 10 which are shown in FIGS. 1 and 2 are integral with the bolt 9, the maximum width of clearances 22 depends on accuracy of finish of the ribs 13 and on accuracy of finish of the connecting unit 8. Thus, the combined width of clearances 22 shown in FIG. 2 depends on the distance between the inner sides of the end portions 10, on the width of the bar 2 (as measured between the two side faces 24) and on the thickness of those parts of the ribs 13 which are engaged by the end portions 10.

The cross-sectional area of each opening 15 must exceed the cross-sectional area of the preferably rod-shaped cylindrical bolt 9 because the latter is integral with the end portions 10. Thus, the cross-sectional area of each opening 15 must at least slightly exceed the cross-sectional area of an end portion 10 in order to allow for assembly of the grate in a manner as shown in FIG. 2. The bolt 9 is thereupon rotated in order to insure that the end portions 10 cannot enter the respective openings 15 and engage or are adjacent to the inner sides 13B of the respective portions or ribs 13. If desired or necessary, the grate of FIGS. 1 and 2 can be provided with means for releasably or yieldably holding the bolt 9 in such angular position in which the end portions 10 are adjacent to the inner sides 13B of the respective ribs 13. This insures that the end portions 10 cannot become disengaged from the ribs 13 when the grate is in use, i.e., when the bar 2 reciprocates with respect to the bars 1 and connecting unit 8, regardless of whether the bars 1 are fixedly mounted in a stationary or mobile frame or support.

The step of the grate which is shown in FIGS. 3 to 6 is constructed and assembled with a view to permit for adjustment of the width of clearances 22 between the side faces 23 and 24 of neighboring grate bars 1 and 2. Adjustability of the width of clearances 22 is attributable to the design of the modified connecting unit or clamp 25 and enables an operator to compensate for manufacturing tolerances of component parts and/or portions of the connecting unit 25 as well as for eventual wear upon the side faces 23 and 24. The connecting unit 25 comprises an elongated coupling member or bolt 26 of polygonal (in the illustrated embodiment rectangular) cross-sectional outline with two hook-shaped integral end portions of retaining elements 27 which are adjacent to the inner sides 13B of the outer flanges or portions 13 of the respective stationary grate bars 1. One of the end portions 27 has a tapped bore 28 for an externally threaded member here shown as a screw 29 whose tip engages the inner side 13B of the respective rib 13. By rotating the screw 29, the person in charge of assembling a step of the grate can vary the width of the clearances 22. The axis of the tapped bore 28 is at least substantially parallel to the longitudinal direction of the bolt 26. The screw 29 will be adjusted upon completed assembly of the step to compensate for manufacturing tolerances of the unit 25 and/or grate bars 1 and 2, or when necessary to compensate for wear upon the side faces 23 and 24, i.e., during intervals between periods of actual use of the grate.

Figure 4:
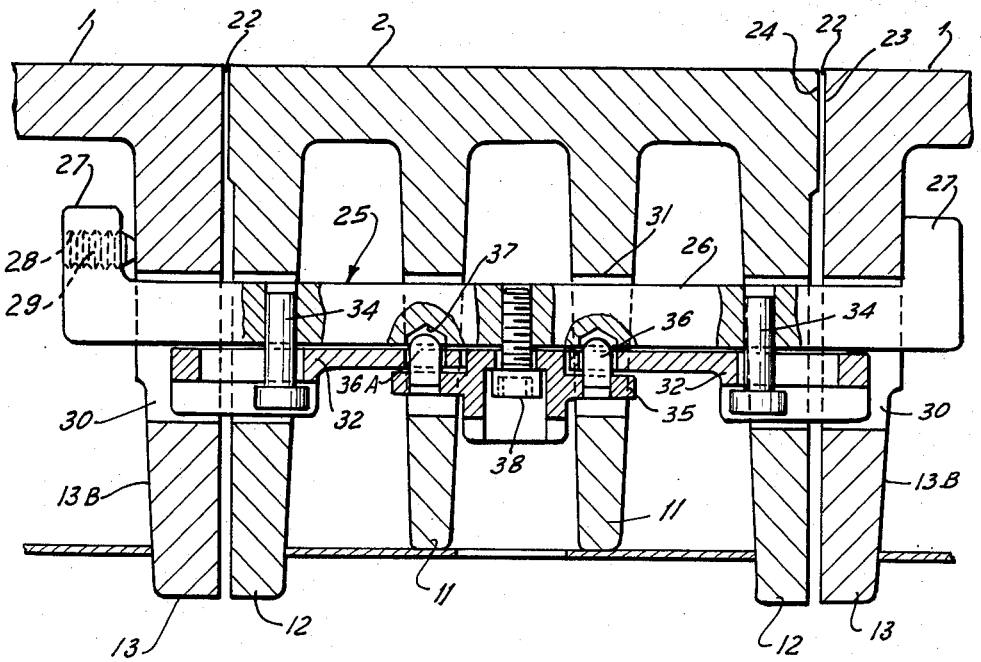
FIG. 4 is an enlarged sectional view as seen in the direction of arrows from the line IV—IV of FIG. 3.

The outer flanges or ribs 13 of the stationary grate bars 1 have openings 30 for introduction of the end portions 27. The height of these openings equals or slightly exceeds the length of the respective end portions 27, as considered at right angles to the axis of the bolt 26. The width of the openings 30 equals or slightly exceeds the corresponding dimension d (see FIG. 3) of the bolt 26. The ribs 11 and 12 of the mobile grate bar 2 have openings or slots 31 which are aligned with the openings 30 and whose length (as considered in the direction of the dimension d) exceeds the width of the bolt 26 to the extent which is required to allow for necessary lengthwise movements of the bar 2 relative to the bars 1. The height of each opening or slot 31 is the same as that of the openings 30, i.e., the end portions 27 can be caused to advance through the slots 31 when the bar 2 is lifted with respect to the position which is shown in FIG. 4 to the extent which is needed to move the surfaces bounding the upper sides of the slots 31 above the topmost parts of the end portions 27. Thus, the slots 31 need not have enlarged portions such as the circular portion of the opening 14, 20 shown in FIG. 1.

In order to insure that the end portions 27 will engage the inner sides 13B of the respective ribs 13, the connecting unit 25 of FIGS. 3 to 6 further comprises two auxiliary locking bolts 32 which can be caused to move into the lower portions of the openings 30 so as to maintain each of the bars 1 or the bolt 26 in the position shown in FIG. 4 in which the end portions 27 extend upwardly beyond the respective openings 30. The auxiliary locking bolts 32 are movable into and from the respective openings 30 by a line 35 which is connected to the inner end portions of the bolts 32 by pivot members 36. A screw 38 which meshes with the central portion of the bolt 26 constitutes a fulcrum for the link 35; this screw is located midway between the pivot members 36. The outer portions of the auxiliary locking bolts 32 (namely, those portions which are nearer to the respective ribs 13) are formed with elongated guide slots 33 for the shanks of pins 34 which are fixedly or separably installed in the bolt 36 and whose lower end portions or heads are enlarged so that they cannot pass through the slots 33. The width of the outer portions of auxiliary bolts 32 corresponds to the width of the bolt 26 (i.e., to the width of the openings 30), and the height of such outer portions equals the difference between the height of the end portions 27 and the thickness of the bolt 26. During introduction of end portions 27 into and through the openings 30, the auxiliary locking bolts 32 are retracted from such openings and the grate bars 1 are lifted (as viewed in FIG. 4) so that the end portions 27 are in full register with the respective openings 30. The bars 1 are thereupon returned to the levels shown in FIG. 4 and the outer portions of auxiliary bolts 32 are introduced into the lower halves of the openings 30 so that the end portions 27 engage the inner sides 13B of the respective ribs 13.

Figure 5:
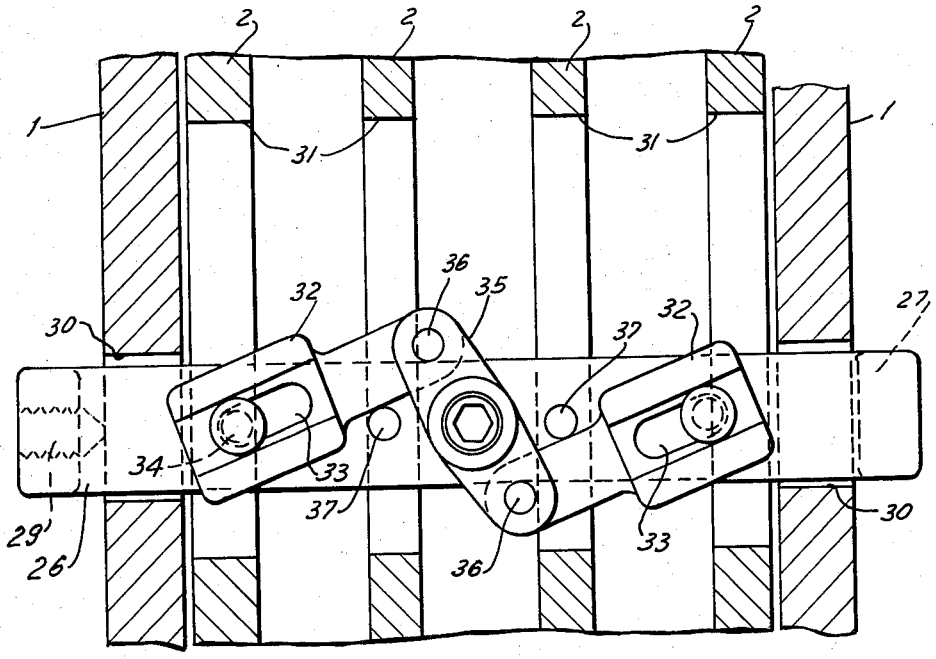
FIG. 5 is a bottom plan view of the structure of FIG. 4, with auxiliary locking bolts of the second connecting unit shown in fully retracted positions.
Figure 6:
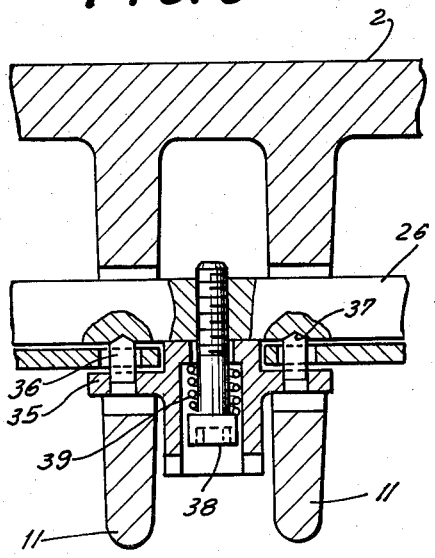
FIG. 6 is a fragmentary sectional view similar to that of FIG. 4 but showing a connecting unit which constitutes a slight modification of the connecting unit of FIGS. 3 to 5.

As shown in FIG. 4, the pivot members 36 have rounded upper end portions 36A which can be introduced into complementary sockets or detent notches 37 in the bolt 26 to thereby releasably hold the auxiliary bolts 32 in their operative positions (shown in FIG. 4). The detent notches 37 are also shown in FIG. 5. The end portions 36A extend upwardly beyond the upper sides of the respective auxiliary bolts 32. Once the end portions 36A enter the corresponding notches 37, the bolts 32 are arrested and held in their operative positions so that the grate bars 1 cannot be moved up or down with respect to the bolt 26. Thus, the openings 30 are then filled, partly by the bolt 26 and partly by the respective auxiliary bolts 32.

In order to allow for pivoting of the link 35 to the position of FIG. 5 in which the outer portions of auxiliary bolts 32 are retracted from the respective openings 30, the attendant rotates the screw 38 so as to enable the link 35 to descend whereby the end portions 36A are withdrawn from the respective detent notches 37 and the link 35 is free to turn about the axis of the screw 38. Thus, the end portions 36A are then free to move past or along the underside of the bar 26. The screw 38 is rotated again when the auxiliary locking bolts 32 are returned to the operative positions of FIG. 4 whereby the end portions 36A of pivot members 36 reenter the adjacent detent notches 37 to insure that the auxiliary bolts 32 remain in such operative positions.

The screw 38 can be replaced with a fixedly installed rivet which allows for some reciprocatory movement of the link 35 toward and away from the underside of the bolt 26. Alternatively, the screw 38 can be retained but need not be rotated in order to cause the pivot members 36 to enter or leave the respective detent notches 37 if the connecting unit further comprises suitable biasing means (e.g., a helical spring 39 shown in FIG. 6) which urges the link 35 upwardly, i.e., toward the underside of the bolt 26. The spring 39 reacts against the head of the screw 38 and bears against an internal shoulder of the link 35 to urge the latter upwardly. When an operator desires to withdraw the pivot members 36 from the detent notches 37, the link 35 is moved downwardly against the opposition of the spring 39 (i.e., the screw 38 need not be rotated at all) whereby the link 35 descends and is free to turn in order to retract the auxiliary locking bolts 32 from the respective openings 30. As a rule, the bolts 32 assume their operative positions and are held in such positions by the spring 39 which holds the link 35 against rotation about the axis of the screw 38 until and unless the bias of the spring 39 is overcome on purpose, i.e., in order to allow for dismantling and removal of the connecting unit including the bolts 26 and 32.

An advantage of the grate which is shown in FIGS. 3 to 6 is that the bars 1, 2 and/or the connecting unit 25 need not be machined with a very high degree of precision because the width of clearances 22 can be regulated by the screw 29. This is desirable because accurate machining of grates 1, 2 and connecting unit 25 contributes to initial cost of the grate. The screw 29 can be rotated to assume a position in which the width of each of the clearances 22 need not exceed one millimeter. Moreoever, the screw 29 can be adjusted during intervals of idleness of the furnace to compensate for eventual wear upon the bars 1, 2 and/or connecting unit 25. The screw 29 actually adjusts the effective length of the bolt 26 to thereby select the distance between the inner sides 13B of the two outer ribs 13 shown in FIG. 4. It is clear that the right-hand end portion 27 of FIG. 4 can also carry one or more screws which perform the same function as the screw 29 so that the axial position of the bolt 26 and/or the distance between the inner sides 13B of the ribs 13 can be regulated by rotating the illustrated screw 29 and/or the screw or screws which mesh with the right-hand end portion 27 and whose tips contact the inner side 13B of the right-hand rib 13 of FIG. 4. Alternatively, the one and/or the other end portion 27 can be threadedly connected with the respective end of the bolt 26 so that the effective length of the connecting unit 25 can be varied by rotating the one and/or the other end portion 27 with respect to the bolt. The end portions may constitute nuts (similar to the nut 76 of FIG. 15) in mesh with external threads (see the threads 75 in FIG. 15) of the bolt 26.

In the embodiment of the grate which is shown in FIGS. 7 to 9, the connecting unit or clamp 40 comprises a round coupling member or bolt 41 with integral hook-shaped end portions or retaining elements 42. One of the end portions 42 has a tapped bore for an adjusting screw 43 which serves the same purpose as the screw 29 of FIG. 4, i.e., to select the width of clearances between the mobile grate bar 2 and the adjacent stationary grate bars 1. The end portions 42 are moved to the operative positions of FIG. 9 by rotating the bolt 41 through the medium of a lever 45. As shown in FIG. 9, the lever 45 is located midway between the inner ribs 11 of the bar 2 and can be rotated by hand or by means of a suitable tool between the two end positions which are shown in FIG. 7 in order to move the end portions 42 into register with or to positions at right angles to the elongated openings 44 in the respective outer ribs 13 of the stationary bars 1.

The ribs 12 and 11 of the bar 2 are respectively formed with elongated slot-shaped openings 46 and 46' through which the end portions 42 can pass when the lever 45 assumes one of its end positions, namely, when the end portions 42 also register with the openings 44 of the outer ribs 13. The openings 46 further receive portions of rectangular slides or sleeves 47 which frictionally engage and surround the respective portions of the round bolt 41. Thus, once the lever 45 is moved to the one of the other end position, it remains in such position unless the force which tends to turn the lever 45 suffices to overcome the friction between the bolt 41 and the slides 47. The slides 47 allow the bar 2 to reciprocate relative to the neighboring bars 1 because their length is less than the length of the openings 46 (see FIG. 7). It is also possible to provide screws or the like to insure that the slides 47 are not rotatable on the bolt 41 or vice versa when the end portions 42 of the bolt 41 engage the inner sides 13B of the respective ribs 13.

The sleeves or slides 47 insure that the round bolt 41 cannot change its angular position (to move the end portions 42 into full register with the openings 44 of the ribs 13) when the grate of FIGS. 7 to 9 is in acutal use. The grate bar 2 is free to reciprocate relative to the sleeves 47; however, the sleeves cannot turn in the openings 46 and, therefore, the round bar 41 remains in the selected angular position as long as the lever 45 is not pivoted to place the end portions 42 into exact register with the respective openings 44. The configuration of the sleeves 47 can be selected practically at will, as long as they prevent unintentional rotation of the bolt 41 with respect to the grate bars 1 and 2.

Another advantage of the grate of FIGS. 7 to 9 is that the cost of the connecting unit 40 can be reduced considerably by making the bolt 41, lever 45 and end portions 42 of a relatively inexpensive material and by making the sleeves 47 of a highly wear-resistant material which can stand long periods of use without wearing away as a result of eventual frictional engagement with surfaces which surround the openings 46 in the ribs 12. Eventual rubbing of mobile grate bar 2 against the connecting unit 40 is possible, though unlikely, if the bar 2 and/or the bars 1 perform at least some stray movements, e.g., up and down as viewed in FIG. 9. Since the sleeves 47 are wear-resistant, such stray movements do not result in excessive wear and the sleeves thereby insure that the grate can be used for long periods of time without any adjustment and/or replacement of parts.

Figure 10:
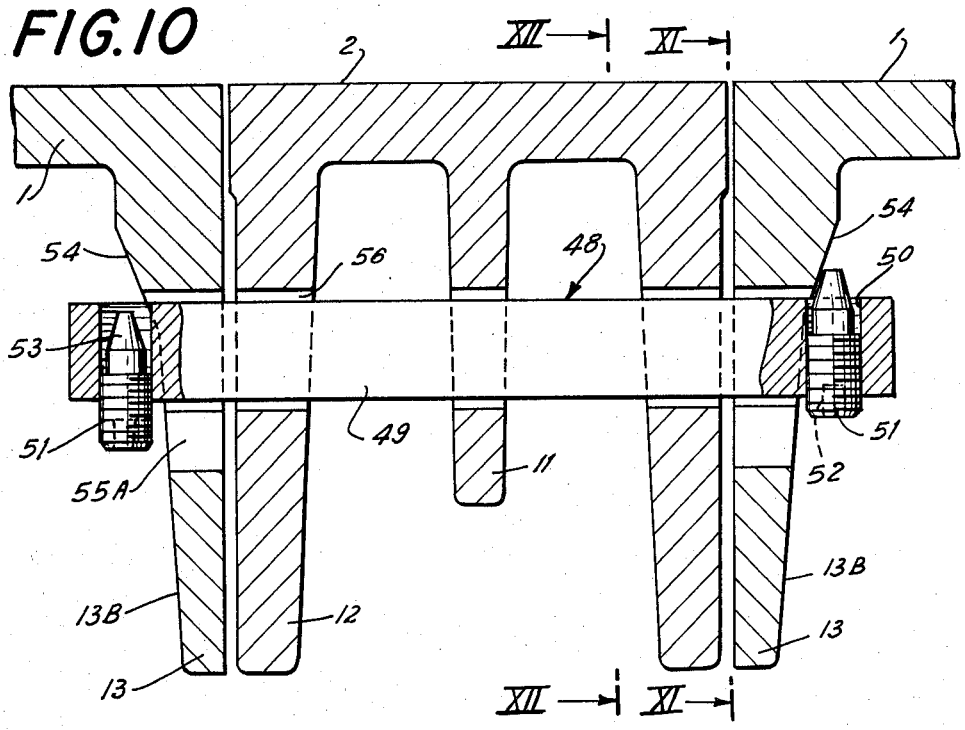
FIG. 10 is a sectional view of a further grate embodying a fourth connecting unit.
Figure 11:
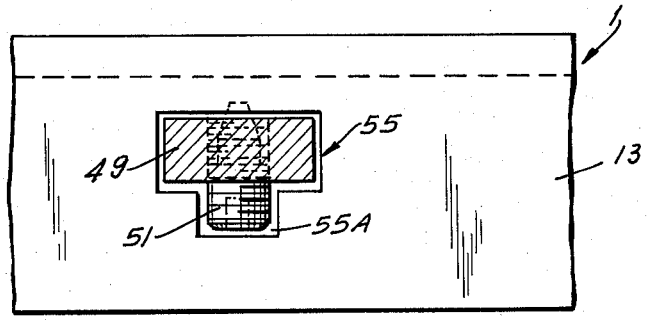
FIG. 11 is a smaller-scale sectional view as seen in the direction of arrows from the line XI—XI of FIG. 10.
Figure 12:
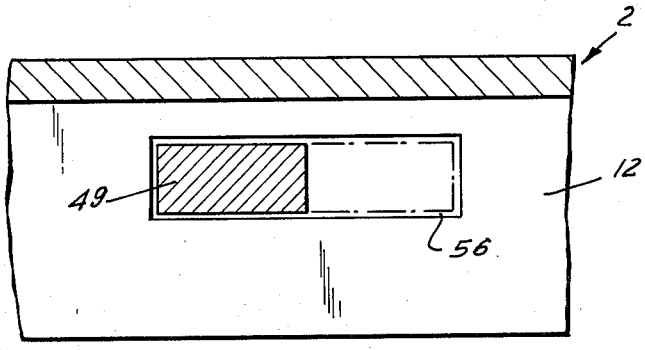
FIG. 12 is a smaller-scale sectional view as seen in the direction of arrows from the line XII—XII of FIG. 10.

FIGS. 10 to 12 illustrate a very simple and inexpensive connecting unit or clamp 48 which comprises a straight flat elongated coupling member or bolt 49 having a rectangular cross-sectional outline (see FIGS. 11 and 12). The ends of the bolt 49 are formed with vertical tapped bores 50 for removable and adjustable end portions in the form of externally threaded members or screws 51 having conical upper end portions or tips 53 movable into engagement with the complementary cam faces 54 at the inner sides 13B of the respective ribs 13 forming part of the stationary grate bars 1. The inclination of cam faces 54 (which form part of the inner sides 13B of the ribs 13) matches or approximates the taper of the respective conical portions 53. The mobile grate bar 2 of FIG. 10 has two outer ribs 12 and a single inner or intermediate rib 11. The openings 56 in the ribs 11 and 12 are elongated slots wherein the bolt 49 is slidable but cannot rotate. The openings 55 in the ribs 13 are T-shaped (see FIG. 11) so that they permit the passage of the bolt 49 and screws 51 therethrough when the screws are moved to the positions corresponding to that of the left-hand screw 51 in FIG. 10, i.e., when the conical tips 53 are fully retracted into the respective tapped bores 50. The lower end faces of the screws 51 have hexagonal or otherwise configurated non-circular sockets 52 for the working ends of suitable tools which are resorted to in order to rotate the screws with respect to the bolt 49, i.e., to move the conical portions 53 into or upwardly and beyond the respective tapped bores 50. The width of clearances between the bar 2 and the adjacent bars 1 can be increased or reduced by causing the one and/or the other screw 51 to move axially, i.e., by changing the extent to which the conical portions 53 extend beyond the upper side of the bolt 49.

In assembling the bars 1 and 2 of FIGS. 10–12, the operator removes the screws 51 from the tapped bores 50 and inserts the bolt 49 into the elongated openings or slots 56 of the ribs 11 and 12. The screws 51 are thereupon connected with the bolt 49 in a manner as shown in FIG. 11 so that they can pass through the openings 55 of the respective ribs 13. In the next step, the screws 51 are rotated in a direction to move the conical portions 53 into engagement with the respective cam faces 54 whereby the assembly and installation of the connecting unit 48 are completed. The length of slots 56 exceeds the corresponding dimension of the bolt 49 to the extent which is required to insure that the bar 2 can reciprocate with respect to the bars 1 through a selected distance, e.g., through a distance corresponding to the width of the bar 49 as viewed in FIG. 12.

It is further clear that the screws 51 can be brought into mesh with the bolt 49 after the latter is moved to the position of FIG. 10. This renders it possible to replace the openings 55 with simple rectangular openings which are slightly larger than the cross-sectional area of the bolt 49.

The advantages of the connecting unit 48 are similar to those of the connecting unit 25 and/or 40, i.e., the effective length of the unit 48 can be varied by changing the axial position of the one and/or the other screw 51. The main difference is that the screws 51 extend at right angles to the longitudinal direction of the bolt 49 and that their conical portions 53 engage inclined cam faces 54 rather than vertical portions of the inner sides 13B of the ribs 13. The connecting unit 48 exhibits the additional advantage that it can employ an extremely simple flat strip-shaped coupling member or bolt 49 whose angular position need not be changed in order to move the screws 51 into requisite engagement with the cam faces 54. The conical portions 53 and the cam faces 54 allow for highly accurate adjustment of maximum width of the clearances at both sides of the mobile grate bar 2.

Figure 15:
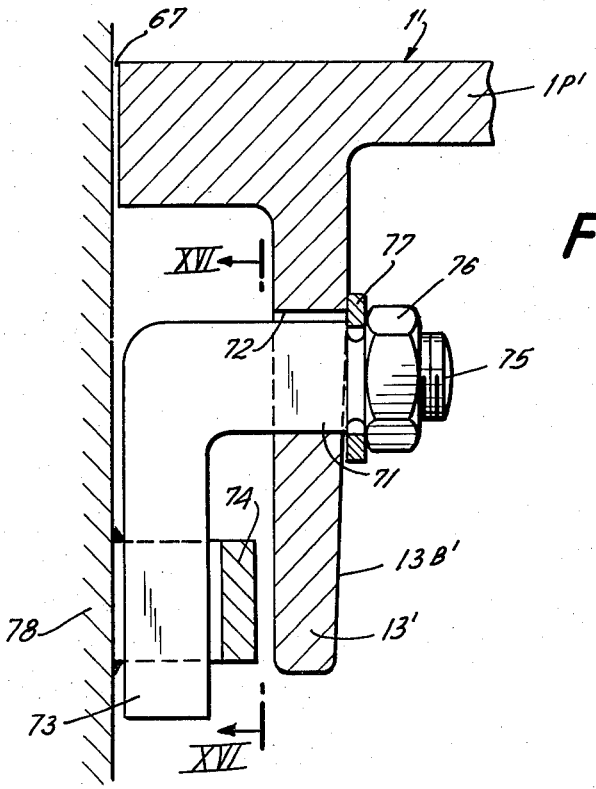
FIG. 15 is a fragmentary sectional view similar to that of FIG. 13 but showing a modified auxiliary connecting unit.

The screws 51 can be replaced with nuts which mesh with externally threaded end portions of the bolt 49. Reference may be had to the nut 76 which is shown in FIG. 15.

The width of narrower lower portions or extensions 55A of the openings 55 in the ribs 13 is less than the width of the bolt 49. Therefore, the bolt 49 cannot descend into the extensions 55A and cannot be extracted from the openings 55 as long as the conical portions 53 of the screws 51 are caused to extend beyond its upper side. It will be noted that the extensions 55A are remote from the conical portions 53 in the fully assembled grate which embodied the structure of FIGS. 10 to 12.

Figure 13:
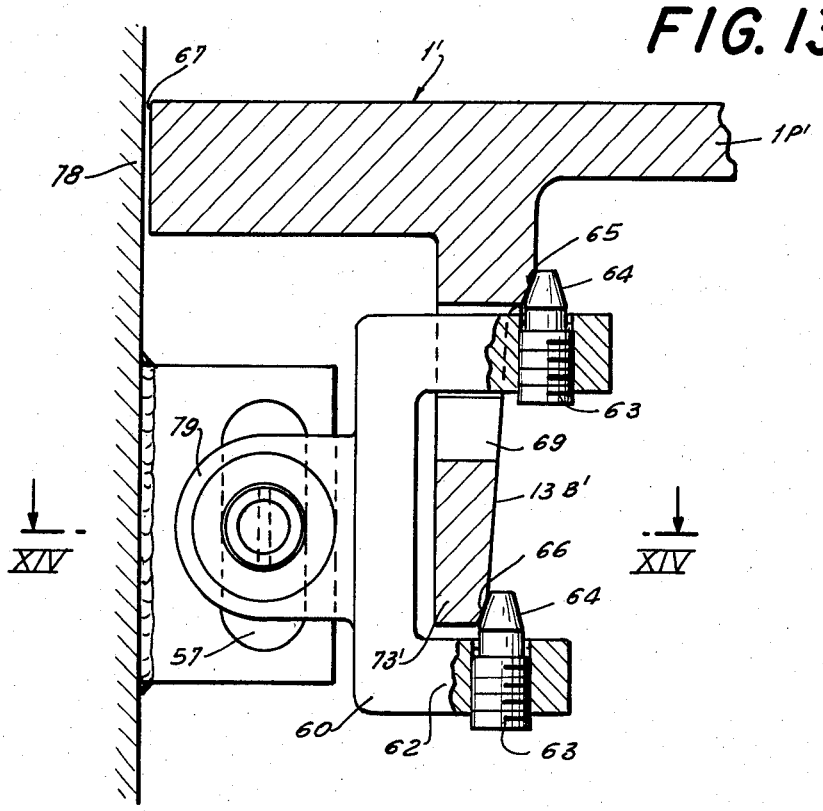
FIG. 13 is a fragmentary sectional view of one outermost stationary grate bar of a grate, further showing an auxiliary connecting unit which adjustably couples the outermost bar to a portion of the frame.
Figure 14:
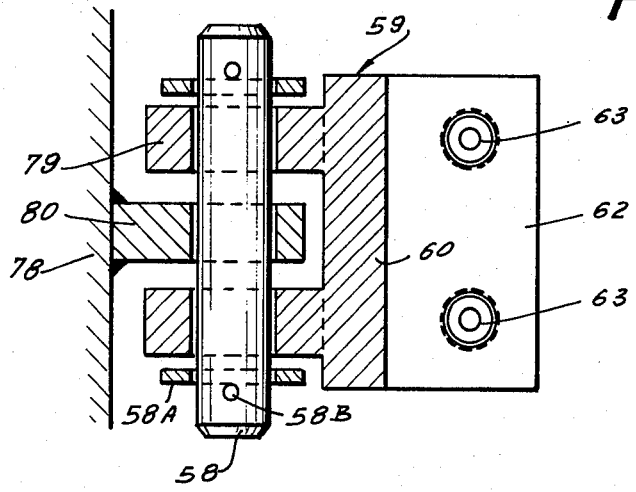
FIG. 14 is a sectional view as seen in the direction of arrows from the line XIV—XIV of FIG. 13.

FIGS. 13 and 14 show the details of an auxilary connecting unit or clamp 59 which secures an outermost stationary grate bar 1' to a plate-like carrier or stop 78 forming part of a preferably stationary frame or support of the respective step of a grate. The carrier 78 is rigidly connected with a bracket 80 having a vertical guide slot 57 for a horizontal pintle or post 58 extending through eyelets or leaves 79 which flank the bracket 80 (see FIG. 14). The guide slot 57 is normal to the plane of the upper side of the platform 1P' of the bar 1'. The end portions of the pintle 58 carry washers 58A which are inwardly adjacent to removable diametral pins 58B and serve to prevent undesired axial displacement of the pintle relative to the bracket 80 and leaves 79. The eyelets or leaves 59 form part of a substantially U-shaped member of the connecting unit 59 which has a base or web 60 rigid with the leaves and two parallel horizontal flanges 61 and 62. The parts 58, 79, 80 constitute a hinge which connects the U-shaped member 60-62 with the carrier 78. The free end portions of the flanges 61 and 62 are formed with vertical tapped bores for pairs of screws 63 having conical portions or tips 64 movable into and from engagement with suitably inclined complementary cam faces 65 and 66 at the inner side 13B' of the outer portion or rib 13' of the grate bar 1'. In a way, the screws 63 correspond to the screws 51 of FIG. 10. The axes of tapped bores for the screws 63 are parallel to the longitudinal extension of the web 60. When the screws 63 are rotated in a direction to move their conical portions 64 upwardly, as viewed in FIG. 13, the width of the gap 67 between the carrier 78 and the adjacent end face of the grate bar 1' decreases. The slot 57 allows the bar 1' to move up or down along the carrier 78 (i.e., at right angles to the upper side of the platform 1P'), e.g., for the purpose of insuring that a connecting unit of the type shown in FIGS. 3-6 can be readily installed to connect the bar 1' with the nearest bar 1 (not shown in FIGS. 13 and 14).

In order to prevent unintentional withdrawal of the flange 61 from the rib 13', the latter is formed with a T-shaped opening 68 whose function is the same as that of the opening 55 shown in FIG. 11. The narrower lower part or extension 69 of the opening 68 allows the upper screw 63 of FIG. 13 and the flange 61 to pass therethrough when the conical portion 64 of such screw is fully retracted into the respective tapped bore of the flange 61.

A step of a grate which embodies the present invention may comprise two outer stationary grate bars 1' and a mobile grate bar 2 therebetween. The mobile grate bar 2 can be coupled to the stationary bars 1' in a manner as shown in FIGS. 1-2, FIGS. 3-6, FIGS. 7-9 of FIGS. 10-12. However, and as already mentioned above, it is also possible to assemble each step of more than three (e.g., five, seven, nine, etc.) stationary and mobile grate bars. If the two outermost stationary grate bars are fixedly secured to the frame of the grate or to the frame of the resepctive step of the grate, the distance between such outermost stationary grate bars is fixed and the connecting unit or units can regulate the width of clearances within the space between the two fixed stationary grate bars.

The structure of FIGS. 13 and 14 is resorted to when the two outermost stationary bars 1' of a step are mounted in such a way that a clearance or gap 67 can develop between an outermost grate bar 1' and the adjacent portion or carrier 78 of the frame. Such clearance is likely to develop when the outermost bars 1' are supposed to or should be free to move relative to the frame. The screws 63 enable an attendant to regulate the width of the gap 67 so as to insure that the distance between the two outermost grate bars 1' does not exceed that distance which would result in the development of rather wide clearances 22 between the mobile grate bar or bars 2 and the neighboring stationary bars 1 and/or 1'. The auxiliary connecting unit 59 of FIGS. 13-14 can be used with equal advantage when the outermost bars 1' are stationary, i.e., when they are not supposed to move relative to the carriers 78. In such instances, too, foreign matter can penetrate between the carriers and the adjacent bars 1' because the bars 1' are not welded or otherwise permanently secured to the frame of the respective step. In the absence of a connecting unit 59, the particles which penetrate into the gap 67 could reduce the distance between the two outermost bars 1' to such an extent that the connecting units of FIGS. 1-12 would be incapable of insuring the development of clearances 22 of requisite width. A self-cleaning action between the carrier 78 and bar 1' of FIG. 13 is not possible if the bar 1' is stationary, i.e., if it does not move relative to the carrier. The particles of foreign matter which penetrates into the gap 67 then remain therein and cause progressive widening of this gap with the aforediscussed results. The screws 63 can be adjusted to insure that the width of the gap 67 does not exceed a maximum permissible value to thereby prevent entry of relatively large particles of stone, rock, clinker and/or metal.

The vertical guide slot 57 is provided when the outermost grate bars 1' are supposed to move up and down, as viewed in FIG. 13, i.e., when the entire step which includes the bar 1' is to perform a pumping action while the grate is in actual use. The movements of the bar 1' take place at right angles to the upper side of its platform 1P'.

Figure 16:
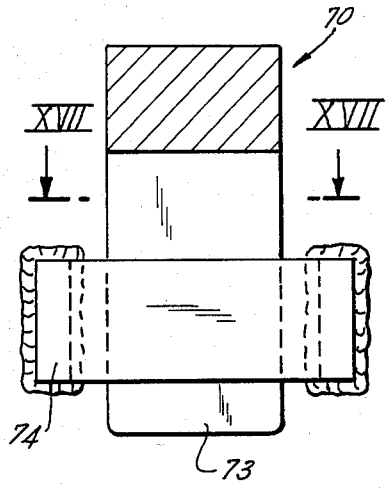
FIG. 16 is a sectional view as seen in the direction of arrows from the line XVI—XVI of FIG. 15.
Figure 17:
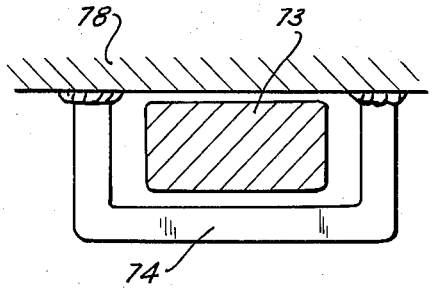
FIG. 17 is a sectional view as seen in the direction of arrows from the line XVII—XVII of FIG. 16.

FIGS. 15 to 17 show a modified auxiliary connecting unit or clamp 70 for an outermost stationary grate bar 1' having an outer portion or rib 13'. The plate-like carrier is shown at 78; it is provided with a bracket 74 having a hole for the vertical leg 73 of L-shaped member 71, 73 of the unit 70. The horizontal leg 71 of the L-shaped member extends through an opening 72 of the rib 13'. The leg 73 is movable up and down in the hole of the bracket 74, i.e., the bar 1' can move up and down along the adjacent surface of the carrier 78. This enables the bar 1' to participate in vertical movements of other grate bars in the same step of the grate.

The outer or free end portion 75 of the leg 71 is formed with external threads meshing with the internal threads of a nut 76 which constitutes a retaining element and holds the rib 13' against movement away from the carrier 78. The width of the gap 67 can be adjusted by rotating the nut 76. A washer 77 is interposed between the nut 76 and the inner side 13B' of the rib 13'. As shown in FIG. 17, the leg 73 has a rectangular cross-sectional outline. The exact configuration of the leg 71 is of no consequence as long as this leg can extend through the opening 72 of the rib 13' and as long as the washer 77 insures that the grate bar 1' cannot be detached from the leg 71 unless the nut 76 is removed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a grate for an industrial furnace or the like, the combination of a support; a pair of spaced apart first elongated grate bars mounted in said support; a second elongated grate bar disposed between and movable relative to said first bars; and means for connecting said first bars to each other, including an elongated coupling member extending transversely of said bars and having first and second ends, and a retaining element disposed at each of said ends and extending transversely of said coupling member, said first bars including portions adjacent to said second bar and having first openings through which said coupling member extends and inner sides adjacent to the respective retaining elements, said second bar including at least one section disposed between said portions of said first bars and having a second opening through which said coupling member extends and which is sufficiently large to allow said second bar to move with respect to said first bars and said connecting means.

2. The combination of claim 1, wherein said second opening is an elongated slot and said second bar is reciprocable with respect to said first bars and said connecting means.

3. The combination of claim 1, wherein the distance between said first bars exceeds the width of said second bar, as considered in the longitudinal direction of said coupling member, so that a clearance is formed between said second bar and at least one of said first bars.

4. The combination of claim 1, wherein said retaining elements are integral with said coupling member.

5. The combination of claim 1, wherein said retaining elements are fixedly connected with the respective ends of said coupling member.

6. The combination of claim 1, wherein the configuration of said first openings matches or approximates the outlines of the respective retaining elements.

7. The combination of claim 1, wherein said connecting means further comprises means for adjusting the maximum distance between said portions of said first grate bars.

8. The combination of claim 7, wherein said adjusting means includes an externally threaded member meshing with one of said retaining elements and movable in the longitudinal direction of said coupling member.

9. The combination of claim 1, wherein at least one of said retaining elements includes an externally threaded member meshing with and movable transversely of said coupling member.

10. The combination of claim 9, wherein said externally threaded member includes a conical portion and the inner side of said portion of the respective first grate bar includes a cam face which is adjacent to and whose inclination at least approximates the taper of said conical portion.

11. The combination of claim 1, wherein at least one end of said coupling member has external threads and the respective retaining element has internal threads mating with said external threads.

12. The combination of claim 1, wherein the configuration of said first openings matches or approximates the outlines of the respective retaining elements and said coupling member is turnable with respect to said grate bars between first and second positions in which said retaining elements are respectively aligned and out of register with the corresponding first openings.

13. The combination of claim 1, wherein said connecting means further comprises sleeve means surrounding said coupling member and received with play in said second opening.

14. The combination of claim 1, wherein said connecting means further comprises auxiliary locking bolts, one for each of said first openings, means for movably mounting said bolts on said coupling member and means for moving said bolts with respect to said coupling member between first and second positions in which said bolts respectively extend into and are withdrawn from the respective first openings.

15. The combination of claim 14, wherein the configuration of said first openings matches or approximates the outlines of the respective retaining elements and said coupling member is movable, in the second positions of said bolts, with respect to said grate bars to a position in which said retaining elements register with the respective first openings.

16. The combination of claim 1, wherein at least one of said retaining elements includes an externally threaded member meshing with and movable transversely of said coupling member, said externally threaded member having a portion which is movable into and from engagement with the respective inner side and the first opening which is adjacent to said externally threaded member being configurated in such a way that said coupling member and said externally threaded member can pass therethrough when said portion of said externally threaded member is disengaged from the respective inner side.

17. The combination of claim 16, wherein said externally threaded member is a screw and said portion thereof is a conical portion, said conical portion being retractable into said coupling member in response to rotation of said screw and said screw further comprising a second portion which extends from said coupling member when said conical portion is retracted into said coupling member, said last mentioned first opening having an extension which registers with said second portion of said screw in the retracted position of said conical portion.

18. The combination of claim 1, wherein one of said first bars is adjacent to said support and further comprising auxiliary connecting means for adjustably coupling said one first bar to said support.

19. The combination of claim 18, wherein said support comprises carrier means adjacent to said one first bar and said auxiliary connecting means includes means for adjustably coupling said one first bar to said carrier means.

20. The combination of claim 19, wherein said means for adjustably coupling said one first bar to said carrier means includes means for permitting said one first bar to move relative to said carrier means in directions substantially at right angles to the longitudinal direction of said one first bar.

21. The combination of claim 19, wherein said means for adjustably coupling said one first bar to said carrier means includes a substantially U-shaped member secured to said carrier means and including a web and two flanges, said one first bar including a platform having an upper surface and said flanges being substantially parallel to said upper surface, said one first bar further including a rib having an opening for one of said flanges and an inner side facing away from said carrier means, said means for adjustably coupling said one first bar to said carrier means further comprising an externally threaded member meshing with said one flange and adjacent to said inner side of said rib.

22. The combination of claim 21, wherein said means for adjustably coupling said one first bar to said carrier means further comprises a second externally threaded member meshing with the other of said flanges and engaging said inner side of said rib.

23. The combination of claim 22, wherein said inner side has two cam faces each adjacent to a different one of said externally threaded members and each of said externally threaded members includes a conical portion engaging the respective cam face.

24. The combination of claim 21, further comprising a hinge which secures said web to said carrier means.

25. The combination of claim 24, wherein said hinge comprises a pintle, a bracket affixed to said carrier means and having an elongated slot for said pintle, and means for connecting said pintle to said web.

26. The combination of claim 19, wherein said means for adjustably coupling said one first bar to said carrier means comprises a substantially L-shaped member having a first leg movably connected with said carrier means and a second leg, said one first bar having a second portion provided with an opening for said second leg, said second portion having an inner side facing away from said carrier means and said second leg comprising a retaining element adjacent to the inner side of said second portion.

27. The combination of claim 26, wherein said one first bar has an elongated platform and said first leg is substantially normal to said platform, said carrier means comprising a bracket reciprocably receiving said first leg.

28. The combination of claim 26, wherein said second leg comprises external threads adjacent to said inner side of said second portion and said retaining element includes a nut meshing with said externally threaded portion.

* * * * *